US005568917A

United States Patent [19]

Buschhaus et al.

[11] Patent Number: 5,568,917

[45] Date of Patent: Oct. 29, 1996

[54] APPARATUS FOR CALIPERING A COLLATED ASSEMBLAGE

[75] Inventors: Michael C. Buschhaus, Springboro; Richard D. Wamsley, Dayton; Thomas Curtis, Centerville, all of Ohio

[73] Assignee: AM International, Inc., Mount Prospect, Ill.

[21] Appl. No.: 272,415

[22] Filed: Jul. 8, 1994

[51] Int. Cl.[6] ..... B65H 7/02

[52] U.S. Cl. ..... 270/58.01; 271/265.04; 270/52.14

[58] Field of Search ..... 270/53, 54, 58, 270/55; 271/262, 263, 265, 265.01, 265.04; 356/381; 250/560

[56] References Cited

U.S. PATENT DOCUMENTS

| | | | |
|---|---|---|---|
| 4,078,784 | 3/1978 | Miaskoff et al. | 271/263 X |
| 4,170,346 | 10/1979 | Murray et al. | 270/54 |
| 4,311,392 | 1/1982 | Yazaki et al. | 356/381 X |
| 4,398,711 | 8/1983 | Horst et al. | 250/560 X |
| 4,773,760 | 9/1988 | Makkonen | 356/381 |
| 4,778,167 | 10/1988 | Snow et al. | 270/58 X |
| 4,937,460 | 6/1990 | Duncan et al. | 271/263 X |
| 4,994,678 | 2/1991 | Sasaki | 356/381 X |
| 5,011,128 | 4/1991 | Tsuji | 271/265 X |
| 5,210,593 | 5/1993 | Kramer | 356/381 |
| 5,222,729 | 6/1993 | Wallaschkowski | 271/262 |

FOREIGN PATENT DOCUMENTS

| | | | |
|---|---|---|---|
| 62-79148 | 4/1987 | Japan | 271/265.04 |
| 2-152843 | 6/1990 | Japan | 271/262 |

*Primary Examiner*—John E. Ryznic
*Attorney, Agent, or Firm*—Tarolli, Sundheim, Covell, Tummino & Szabo

[57] ABSTRACT

A calipering assembly (40) is provided for use along a collating conveyor (14) having collated assemblages (20) thereon. The calipering assembly comprises a movable member (60) in the form of a wheel having an outer circumferential surface which engages a collated assemblage when the member is moved toward a collated assemblage. The outer circumferential surface of the member includes a light reflective surface portion (83) against which light (37) is directed and then reflected (38). A light sensor (39) senses the reflected light from the light reflective surface portion of the outer circumferential surface of the member. A processor (44) cooperates with the light sensor to provide a signal (42) which varies as a function of the thickness of the collated assemblage.

14 Claims, 2 Drawing Sheets

APPARATUS FOR CALIPERING A COLLATED ASSEMBLAGE

TECHNICAL FIELD

The present invention relates to a collator for forming collated assemblages on a collating conveyor, and particularly relates to an apparatus for calipering a collated assemblage on a collating conveyor.

BACKGROUND ART

A known calipering device is disclosed in U.S. Pat. No. 4,170,346. In U.S. Pat. No. 4,170,346, the calipering device is in the form of a non-contacting capacitive change measuring device which determines the page count of books as the books move along a bindery assembly line. The calipering device includes a capacitive detector head having a pair of spaced capacitor plates. The pages of each book pass through the space between the plates as the book is conveyed along the bindery assembly line. An oscillator produces a variable frequency of oscillation proportional to the number of pages of the book passing between the plates. The frequency of oscillation is sampled for a predetermined time period. The sampled pulses are counted and compared to a standard within tolerances. The comparison determines whether the page count of the book being measured is acceptable.

A problem associated with some known calipering devices is their relatively poor resolution resulting from the use of some type of magnification arrangement, such as the use of mechanical levers, to magnify a relatively small distance value which is being measured. The magnification arrangement is required to convert the relatively small distance value to a value large enough to be processed by a sensor or a processing unit. The use of such magnification arrangement introduces error into the measured value and thereby limits the resolution of the calipering device.

SUMMARY OF THE INVENTION

In accordance with the present invention, an apparatus is provided for use along a collating conveyor having collated assemblages thereon. The apparatus comprises a movable member having an outer circumferential surface which engages a collated assemblage when the member is moved toward the collated assemblage. A light source directs light toward the outer circumferential surface of the member. The outer circumferential surface of the member includes a light reflective surface portion against which light is directed from a light source and then reflected. The reflected light has a characteristic which varies as a function of the thickness of the collated assemblage. Means is also provided for sensing the reflected light from the light reflective surface portion of the outer circumferential surface of the member. Means is provided for providing a signal which varies as a function of the characteristic of the reflected light and thus as a function of the thickness of the collated assemblage.

In the preferred embodiment of the present application, the movable member comprises a rotatable wheel. The outer circumferential surface of the wheel comprises the light reflective surface portion and an engaging surface portion which engages the collated assemblage. The light reflective surface portion has a diameter which is smaller than the diameter of the engaging surface portion. Also, the light reflective surface portion includes a coating which reduces spurious light reflections. Preferably, the light source includes means for providing a laser beam, and the means for receiving the reflected light includes a laser beam sensor.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF PREFERRED EMBODIMENT

The present invention is directed to a calipering assembly for use along a collating line. The specific construction and use of the calipering assembly may vary. By way of example, a calipering assembly constructed in accordance with the present invention is embodied in a saddle binding line which forms collated assemblages along a collating conveyor chain.

Figure 1:
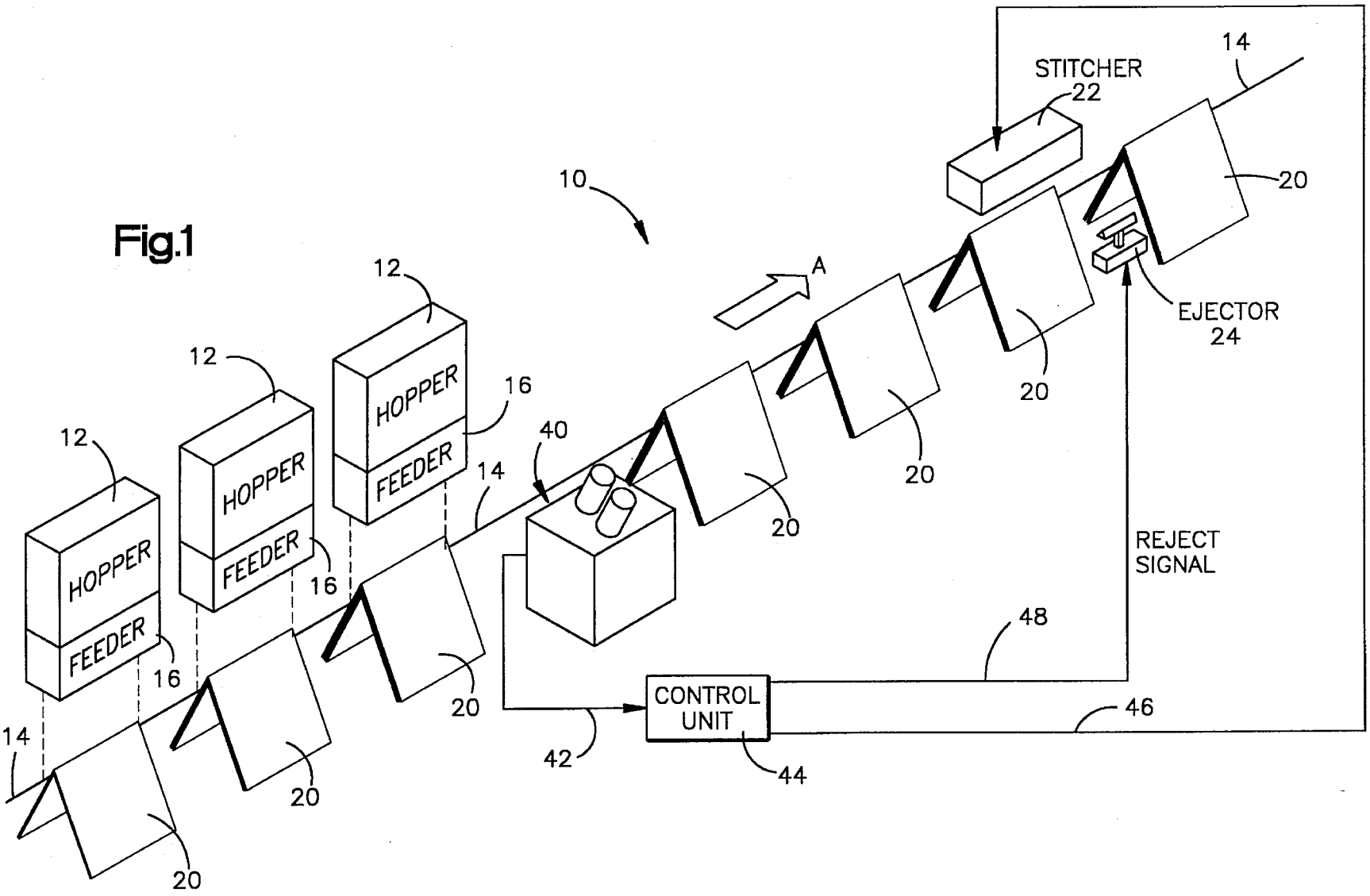
FIG. 1 is a schematic diagram of a collating line incorporating a calipering assembly constructed in accordance with the present invention.

Referring to FIG. 1, a typical saddle binding line 10 includes a plurality of hoppers 12 which store signatures and a collating conveyor chain 14 which is movable past the hoppers 12. A plurality of feeders 16 are operatively connected to the hoppers 12 to feed signatures from the hoppers 12 onto the conveyor chain 14 to form collated assemblages 20 on the conveyor chain 14. The number of feeders is equal to the number of hoppers. Each feeder is associated with a respective hopper. The conveyor chain 14 carries the collated assemblages 20 in a sequence at regularly spaced intervals to a stitcher 22. An ejector 24 is located downstream of the stitcher 22. The direction of flow of the collated assemblages 20 is indicated by the arrow A.

In accordance with the present invention, a calipering assembly 40 is disposed along the conveyor chain 14 for calipering each of the collated assemblages 20 to determine whether the page count of each collated assemblage is acceptable. The calipering assembly 40 provides a signal on line 42 which is indicative of the thickness of a collated assemblage passing through the calipering assembly 40. A control unit 44 receives the thickness signal on line 42 and processes the signal on line 42 to determine whether the page count of the collated assemblage passing through the calipering assembly 40 is acceptable.

Specifically, the control unit 44 determines whether the page count of the collated assemblage passing through the calipering assembly 40 is acceptable by comparing the value of the signal on line 42 with a known thickness value stored in a memory of the control unit 44. If the value of the signal on line 42 is within an acceptable range of the thickness value stored in the memory of the control unit 44, the collated assemblage being measured is deemed to have the correct number of pages and, therefore, a good product. If the value of the signal on line 42 is not within the acceptable range of the thickness value stored in the memory of the control unit 44, the collated assembly being measured is deemed to have an incorrect number of pages and, therefore, a bad product. The range of acceptability is manually adjustable and can be displayed in the form of a bar graph display in the plus and/or negative directions.

When a collated assemblage passing through the calipering assembly 40 is found to have less than the required number of pages, or an excess number of pages, or other measured abnormality, on the basis of the thickness signal on line 42, the control unit 44 identifies the collated assemblage as unacceptable and generates a stitcher inhibit signal on line 46 which is applied to the stitcher 22. The control unit 44 includes a suitable memory device, such as a shift register, which delays the generation of the stitch inhibit signal on line 46 subsequent to detection of the unacceptable collated assemblage until that particular collated assemblage is positioned along the collating line 10 opposite the stitcher 22. Accordingly, the stitch inhibit signal on line 46 prevents the operation of the stitcher 22 for that particular collated assemblage.

After the control unit 44 generates the stitch inhibit signal on line 46, the control unit 44 generates a reject signal on line 48 which is applied to the ejector 20. The memory device of the control unit 44 delays the generation of the reject signal on line 48 for a predetermined time period subsequent to the generation of the stitch inhibit signal on line 46. The generation of the reject signal on line 48 is delayed until the unacceptable collated assemblage is positioned along the collating line 10 opposite the ejector 24. Accordingly, the reject signal on line 48 actuates the ejector 24 to eject the unacceptable collated assemblage from the conveyor chain 14.

Figure 2:
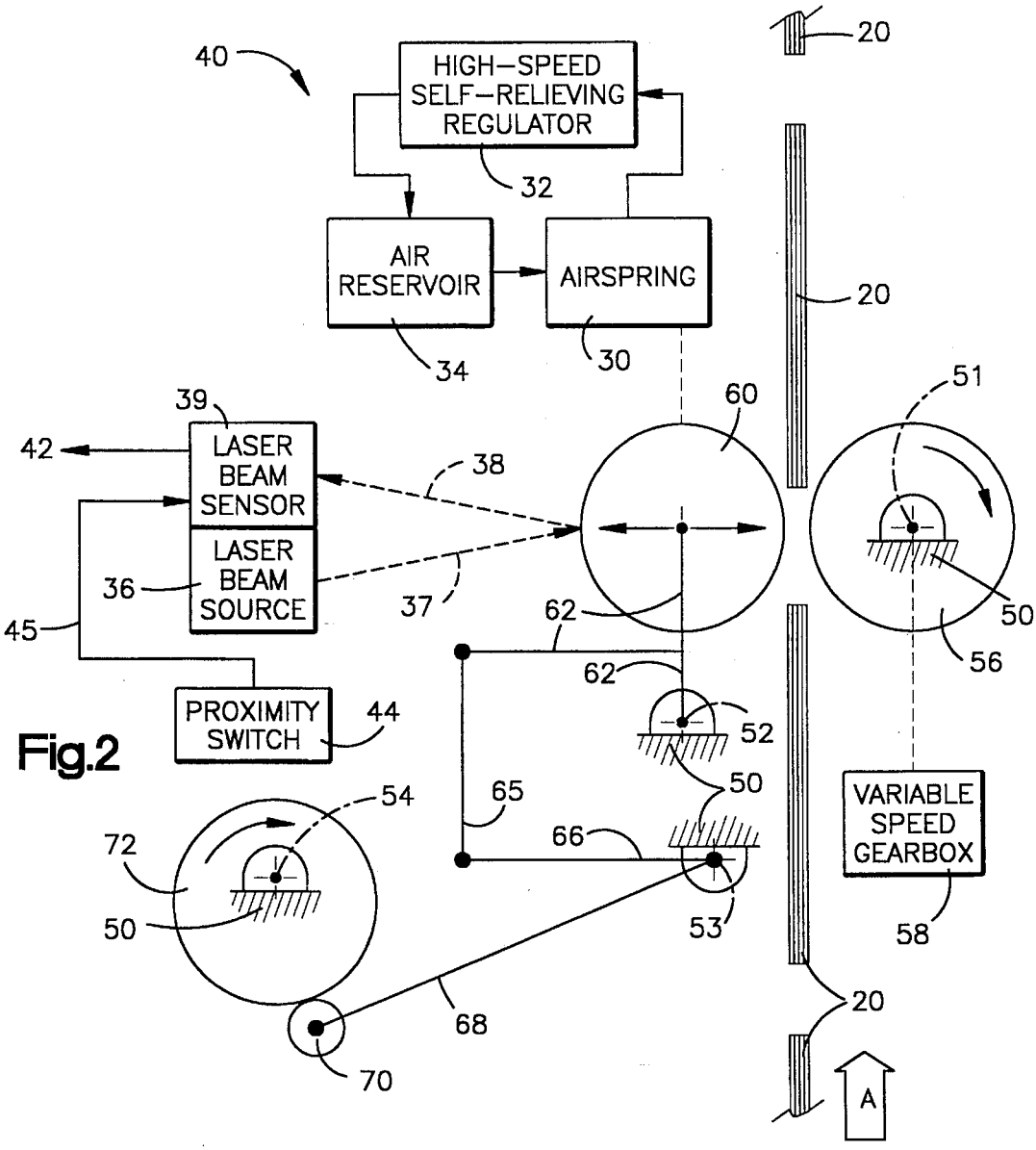
FIG. 2 is a schematic diagram of the calipering assembly of FIG. 1.

Referring to FIG. 2, the structure of the calipering assembly 40 is schematically illustrated. The calipering assembly 40 comprises a frame 50 having a first bearing point 51, a second bearing point 52, a third bearing point 53, and a fourth bearing point 54. A wheel 56 is mounted for rotation about its own center axis and about a pivot pin at the first bearing point 51 on the frame 50. The center axis of the wheel 56 is fixed. A variable speed gear box 58 is drivingly connected to the wheel 56 to rotate the wheel 56 about its own center axis in a known manner. As shown in FIG. 2, the wheel 56 is driven to rotate in the clockwise direction. The structure and operation of variable speed gear boxes are known and, therefore, will not be described herein.

A movable wheel 60 in the form of a solid steel shaft is spaced apart from the wheel 56. The movable wheel 60 is free to rotate about its own center axis and is movable toward and away from the wheel 56. The movable wheel 60 is mounted for rotation about its own center axis and is mechanically coupled through a link arrangement 62 to a pivot pin at the second bearing point 52. One end of a tie bar 65 is attached by a pivot pin to the link arrangement 62, as schematically shown in FIG. 2. The opposite end of the tie bar 65 is attached by a pivot pin to one end of a link member 66. The other end of the link member 66 is clamped to a pivot shaft at the third bearing point 53 such that the link member 66 can pivot about the axis of the pivot shaft at the third bearing point 53 upon rotation of the pivot shaft.

One end of a cam lever arm 68 is also clamped to the pivot shaft at the third bearing point 53. The cam lever arm 68 is thus also pivotable about the axis of the pivot shaft at the third bearing point 53. The position of the 10 cam lever arm 68 and the position of the link member 66 may be adjusted relative to each other by adjusting the clamps (not shown) which clamp the cam lever arm 68 and the link member 66 to the pivot shaft at the third bearing point 53.

When the cam lever arm 68 and the link member 66 are clamped to the pivot shaft at the third bearing point 53, the cam lever arm 68, the link member 66, and the pivot shaft are pivotable as a unit about the axis of the pivot shaft at the third bearing point 53. The movable wheel 60 moves either toward or away from the fixed wheel 56 depending upon the direction of the pivotal movement of the cam lever arm 68 and the link member 66 about the axis of the pivot shaft at the third bearing point 53.

The other end of the cam lever arm 68 is connected to a cam follower 70 which comprises a roller which rotates relative to the cam lever arm 68. A cam 72 is mounted for rotation about the axis of a shaft at the fourth bearing point 54 on the frame 50 in a clockwise direction, as illustrated in FIG. 2. The cam 72 has high and low spots about its periphery. The cam 72 controls the position of the cam follower 70 in accordance with the high and low spots on the cam 72.

When a high spot on the cam 72 engages the cam follower 70, the cam lever arm 68 pivots about the axis of the pivot shaft at the third bearing point 53 in a direction which, in turn, causes the link member 66 to pivot about the axis of the pivot shaft at the third 10 bearing point 53. This pivoting of the link member 66 causes the tie bar 65 and the link arrangement 62 to pivot as a unit about the axis of the pivot pin at the second bearing point 52 in one direction. The unit pivots about the axis of the pivot pin at the second bearing point 52 in a direction such that the movable wheel 60 moves away from the wheel 56.

When the low spot on the cam 72 engages the cam follower 70, the cam lever arm 68 pivots about the axis of the pivot shaft at the third bearing point 53 in a direction which, in turn, causes the link member 66 to pivot about the axis of the pivot shaft at the third bearing point 53. The tie bar 65 and the link arrangement 62 then pivot as a unit about the pivot pin at the second bearing point 52 in a direction such that the movable wheel 60 moves toward the wheel 56.

Figure 3:
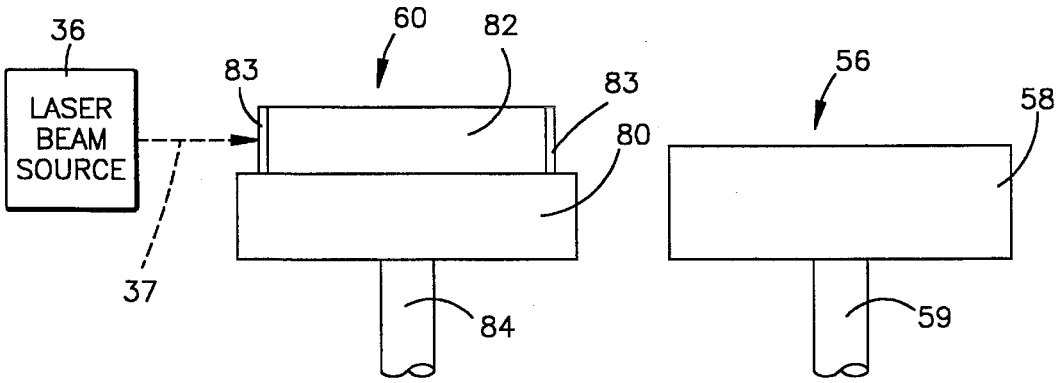
FIG. 3 is an elevational view of wheel members used in the calipering assembly of FIG. 2.

Referring to FIG. 3, the structure of the wheel 56 and the structure of the movable wheel 60 are schematically illustrated. The wheel 56 has a wheel portion 58 and a shaft portion 59. The movable wheel 60 comprises a larger diameter wheel portion 80 interconnecting a smaller diameter wheel portion 82 and a shaft portion 84. The smaller diameter wheel portion 82 has a smaller diameter than the larger diameter wheel portion 80 and, therefore, does not contact a collated assemblage being measured when the movable wheel 60 is moved into engagement with the collated assemblage being measured. Since the smaller diameter wheel portion 82 does not contact a collated assemblage being measured, ink from the collated assemblage will not build up on the smaller diameter wheel portion 82.

The smaller diameter wheel portion 82 serves as a light target for a source of light and is coated on its outer surface with a coating 83 to minimize spurious light reflections. The coating 83 comprises a ceramic material which is applied to the outer surface of the smaller diameter wheel portion 82 via a plasma spraying process. The ceramic material may be a powder which is melted and then sprayed onto the outer surface of the smaller diameter wheel portion 82. Preferably, the powder is APS 1001 alumina manufactured by APS Materials, Inc. of Dayton, Ohio.

After the sprayed material dries, the rough surface of the dried material is ground to a smooth finish to provide the coating 83. Preferably, the smooth finish of the coating 83 has a roughness average of no greater than 32 microinches as governed by the standard ANSI B46.1-1978. The outer surface of the coating 83 is axially adjacent the outer surface of the larger diameter wheel portion 80, as shown in FIG. 3.

An air spring 30 is located adjacent the movable wheel 60. The air spring 30 is controlled to apply a force to the movable wheel 60. The force is applied to urge the movable wheel 60 in a direction which presses the movable wheel 60 against the collated assemblage being measured to remove air from the collated assemblage and to press the pages of the collated assemblage together before a measurement is made.

A high speed self-relieving regulator 32 and air reservoir 34 controls the air supply to the air spring 30. The regulator 32 and air reservoir 34 maintain a constant pressure in the air spring 30, thereby maintaining a consistent force applied to a collated assemblage passing between the wheel 56 and the movable wheel 60. By applying a consistent force to a collated assemblage being measured, consistent measurements are obtainable. The force applied against a collated assemblage being measured can be adjusted on the fly by simply increasing or decreasing the pressure in the air spring 30 by operating the regulator 32 accordingly.

Further, the air spring 30 provides vibration damping characteristics which take effect at operating speeds above 250 cycles per minute. This eliminates the need for additional mechanical hardware to counter vibration when the calipering assembly 40 operates at such higher speeds.

Referring to FIGS. 2 and 3, a source of light 36 in the form of a laser beam source provides a laser beam 37 which is directed at the coated surface 83 of the smaller diameter wheel portion 82 of the movable wheel 60. The laser beam 37 is preferably continuously on. The laser beam 37 is reflected from the coated surface 83 of the smaller diameter wheel portion 82 of the movable wheel 60. The reflected laser beam is designated with reference numeral 38. As mentioned hereinabove, the coated surface 83 of the smaller diameter wheel portion 82 serves to minimize spurious light reflections.

A sensor 39 in the form of a laser beam sensor receives the reflected laser beam 38. The laser beam sensor 39 includes a sample and hold circuit (not shown) which is triggered in response to a trigger signal on line 45 from a proximity switch 44 located in the vicinity of the cam 72. The proximity switch 44 is operatively coupled with the cam 72 such that the proximity switch 44 provides the trigger signal on line 45 when the low spot on the cam 72 engages the cam follower 70. Thus, the trigger signal on line 45 is provided when the movable wheel 60 is moved toward the wheel 56 to engage a collated assemblage passing between the movable wheel 60 and the wheel 56.

When the trigger signal on line 45 is applied to the sample and hold circuit of the laser beam sensor 39, a characteristic of the reflected laser beam 38 is measured. This characteristic of the reflected laser beam 38 varies as a function of the thickness of the collated assemblage being measured and is, preferably, proportional to the thickness of the collated assemblage being measured. The laser beam sensor 39 further includes processing circuitry (not shown) which generates and provides the thickness signal on line 42 in response to the characteristic of the reflected laser beam 38 being measured. The thickness signal on line 42 is directed to the control unit 44 for further processing as described hereinabove.

A number of advantages result by providing the calipering assembly 40 including the laser beam source 36 and the laser beam sensor 39 according to the present invention. One advantage is that a high resolution of a measured distance value corresponding to the thickness of a collated assemblage being measured is obtained. A high resolution is obtained because the laser beam sensor 39 is able to read and process the measured distance value without any magnification. Since no magnification of the measured distance value is required, no error due to magnification is introduced. Another advantage is that only minimal mechanical set up of the sensor portion of the calipering assembly 40 is required.

From the above description of the invention, those skilled in the art to which the present invention relates will perceive improvements, changes and modifications. Such improvements, changes and modifications within the skill of the art to which the present invention relates are intended to be covered by the appended claims.

Having described the invention, the following is claimed:

1. An apparatus for use along a collating conveyor having collated assemblages thereon, said apparatus comprising:

a movable member comprising a rotatable wheel having a first circumferential surface which engages a collated assemblage when said movable member is moved towards the collated assemblage;

a light source for directing a light beam toward said movable member;

said movable member further including a second circumferential surface, said second circumferential surface being a light reflective surface portion against which said light beam is directed and then reflected, said light reflective surface portion having a different diameter than the diameter of said collated assemblage engaging surface portion; and means for sensing said reflected light beam from said light reflective surface portion of said movable member.

2. An apparatus according to claim 1 wherein said light reflective surface portion includes a coating for minimizing spurious light reflections.

3. An apparatus according to claim 1 further comprising air spring means for biasing said collated assemblage engaging surface portion against a collated assemblage.

4. An apparatus according to claim 3 further comprising means for regulating the biasing force of said air spring to maintain a constant pressure to maintain a constant force on a collated assemblage.

5. An apparatus according to claim 1 wherein light source comprises means for providing a laser beam.

6. An apparatus according to claim 5 wherein said means for receiving the reflected light includes a laser beam sensor.

7. The apparatus of claim 1 wherein said different diameter of said light reflecting portion is smaller than the diameter of said collated assemblage engaging surface portion.

8. An apparatus comprising:

a plurality of hoppers for storing signatures;

a collating conveyor movable past said plurality of hoppers;

means for feeding signatures from said plurality of hoppers onto said collating conveyor to form a collated assemblage on said collating conveyor; and caliper means for sensing the thickness of a collated assemblage on said collating conveyor and for providing a thickness signal indicative thereof;

said caliper means including a first wheel member and a second wheel member having a first surface portion for engaging the collated assemblage;

means for supporting said second wheel member for movement toward said first wheel member to engage a collated assemblage between said first and second wheel members as said collating conveyor moves a collated assemblage between said first and second wheel members;

said second wheel member further including a light reflective surface portion, said light reflective surface portion having a diameter which is different than the diameter of said first surface portion, said first surface portion and said light reflective surface portion being axially adjacent to each other;

said caliper means further including means for providing a light beam which is directed onto said light reflective surface portion of said second wheel member when a collated assemblage is engaged between a said first and second wheel members; and means for receiving a reflected light beam from said light reflective surface portion of said second wheel member.

9. An apparatus according to claim 8 wherein said reflective surface portion of said second wheel member includes a coating for minimizing spurious light reflections.

10. An apparatus according to claim 8 further comprising air spring means for biasing said first surface portion of said second wheel member against a collated assemblage to press the collated assemblage between said first and second wheel members.

11. An apparatus according to claim 10 further comprising means for regulating the biasing force of said air spring means to maintain a constant pressure to maintain a constant force on a collated assemblage between said first and second wheel members.

12. An apparatus according to claim 8 wherein said means for providing light includes means for providing a laser beam.

13. An apparatus according to claim 12 wherein said means for receiving the reflected light includes a laser beam sensor.

14. The apparatus of claim 8 wherein said different diameter of said light reflecting portion is smaller than the diameter of said collated assemblage engaging surface portion.

* * * * *